US006298582B1

(12) United States Patent
Friton et al.

(10) Patent No.: US 6,298,582 B1
(45) **Date of Patent: *Oct. 9, 2001**

(54) ARTICLE OF FOOTWEAR WITH HEEL CLIP

(75) Inventors: Michael R. Friton, Portland; Tobie D. Hatfield; David J. Schenone, both of Beaverton; John C. Tawney, Portland, all of OR (US)

(73) Assignee: Nike, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/016,294

(22) Filed: Jan. 30, 1998

(51) Int. Cl.[7] ..... A43B 23/28; A43B 7/14; A43B 7/20; A43B 1/10; A43B 5/00

(52) U.S. Cl. ..... 36/88; 36/92; 36/102; 36/103; 36/114; 36/58.6; 36/58.5; 36/69; 36/80; 36/89

(58) Field of Search ..... 36/88, 91, 92, 36/102, 103, 114, 32 R, 45, 58.6, 58.5, 69, 80, 150, 89, 50.1, 170, 145, 7.1 R, 7.4

(56) References Cited

U.S. PATENT DOCUMENTS

| | | | | |
|---|---|---|---|---|
| D. 205,755 | * | 9/1966 | Slade | 36/7.1 R |
| D. 384,053 | | 9/1997 | Smith, III . | |
| D. 385,403 | | 10/1997 | Kuerbis . | |
| D. 387,549 | | 12/1997 | Rusnak . | |
| D. 387,885 | | 12/1997 | Fogg . | |
| D. 391,062 | | 2/1998 | Hatfield . | |
| D. 391,068 | | 2/1998 | Aveni et al. . | |
| 449,340 | * | 3/1891 | Varley | 36/58.5 |
| 471,476 | * | 3/1892 | Garcia | 36/58.5 |

(List continued on next page.)

FOREIGN PATENT DOCUMENTS

| | | | |
|---|---|---|---|
| 890 466 | 7/1949 | (DE) . | |
| 527169 | 10/1940 | (GB) . | |
| 576175 | 3/1946 | (GB) . | |
| 1088685 | 10/1967 | (GB) . | |
| 1170381 | 11/1969 | (GB) . | |
| 1 214 430 | 12/1970 | (GB) . | |
| 1 491 634 | 11/1977 | (GB) . | |
| 2 188 224 | 9/1987 | (GB) . | |
| 2 192 325 | 1/1988 | (GB) . | |
| 2 228 179 | 8/1990 | (GB) . | |
| 2 237 971 | 5/1991 | (GB) . | |
| WO 91/05491 | 5/1991 | (WO) . | |
| 91/11924 * | 8/1991 | (WO) | 36/102 |
| WO 91/16830 | 11/1991 | (WO) . | |

OTHER PUBLICATIONS

Five Ten 1996 Dealer Workbook, Moccasym and Anasazi shoes on pp. 16 and 19.

*Primary Examiner*—Paul T. Sewell
*Assistant Examiner*—Anthony Stashick
(74) *Attorney, Agent, or Firm*—Banner & Witcoff, Ltd.

(57) ABSTRACT

An article of footwear, e.g., a shoe for running, jogging, and walling, that is designed to provide a better and more anatomical fit to the wearer's foot to enhance performance and provide better arch support. The shoe includes an articulated arch that is independent from the main sole unit to provide better arch support, optimal comfort, and enhanced articulation. A heel notch is cut in the medial and lateral quarter panels to enable the shoe to move in a manner more like the human foot. A heel clip is provided, in lieu of a traditional heel counter, to provide a secure fit in the heel region without the inflexibility and discomfort of a traditional heel counter.

36 Claims, 6 Drawing Sheets

U.S. PATENT DOCUMENTS

| | | | | |
|---|---|---|---|---|
| 588,919 | * | 8/1897 | Fry | 36/58.5 |
| 884,520 | * | 4/1908 | McIntire | 36/58.5 |
| 1,079,149 | * | 11/1913 | Schuey | 36/58.5 |
| 1,494,236 | * | 5/1924 | Greathouse | 36/80 |
| 2,765,545 | | 10/1956 | Conrad, Sr. . | |
| 3,613,274 | * | 10/1971 | Willey | 36/68 |
| 3,768,182 | * | 10/1973 | Powers | 36/114 |
| 4,258,480 | | 3/1981 | Famolare, Jr. . | |
| 4,262,433 | | 4/1981 | Hagg et al. . | |
| 4,296,558 | * | 10/1981 | Antonious | 36/50.1 |
| 4,316,334 | | 2/1982 | Hunt . | |
| 4,354,319 | | 10/1982 | Block et al. . | |
| 4,364,189 | | 12/1982 | Bates . | |
| 4,389,798 | | 6/1983 | Tilles . | |
| 4,501,077 | | 2/1985 | Young . | |
| 4,559,723 | | 12/1985 | Hamy et al. . | |
| 4,574,498 | * | 3/1986 | Norton et al. | 36/114 |
| 4,615,126 | | 10/1986 | Mathews . | |
| 4,660,301 | | 4/1987 | Atwood . | |
| 4,694,591 | | 9/1987 | Banich et al. . | |
| 4,704,808 | * | 11/1987 | Bianchini et al. | 36/102 |
| 4,785,557 | * | 11/1988 | Kelley et al. | 36/32 R |
| 5,184,410 | | 2/1993 | Hamilton . | |
| 5,319,866 | | 6/1994 | Foley et al. . | |
| 5,400,528 | | 3/1995 | Skinner et al. . | |
| 5,408,761 | * | 4/1995 | Gazzano | 36/88 |
| 5,430,959 | | 7/1995 | Mitsui . | |
| 5,463,822 | * | 11/1995 | Miller | 36/50.1 |
| 5,465,509 | * | 11/1995 | Fuerst et al. | 36/88 |
| 5,481,814 | | 1/1996 | Spencer . | |
| 5,491,911 | | 2/1996 | Chen . | |
| 5,557,866 | | 9/1996 | Prengler . | |
| 5,678,329 | * | 10/1997 | Griffin et al. | 36/50.1 |
| 5,692,319 | * | 12/1997 | Parker et al. | 36/50.1 |
| 5,819,439 | * | 10/1998 | Sanchez | 36/89 |
| 5,842,292 | * | 12/1998 | Siesel | 36/58.5 |

* cited by examiner

ARTICLE OF FOOTWEAR WITH HEEL CLIP

FIELD OF THE INVENTION

This invention relates to an article of footwear. More specifically, the invention relates to an article of footwear, especially for running, jogging, and walking, designed to provide a better and more anatomical fit to the wearer's foot to enhance performance and provide better arch support.

BACKGROUND OF THE INVENTION

Athletic shoes normally include a sole for providing traction and cushioning, and an upper for holding the foot of the wearer to the sole. The soles ordinarily have a multi-layer construction comprised of an outsole and a midsole. The outsole is normally formed of a durable material to resist wearing of the sole during use. The midsole ordinarily forms the middle layer of the sole and is typically composed of a soft foam material to cushion the impact forces and pressure experienced by the foot during athletic activities. The foam midsole may be formed with or without the inclusion of other cushioning elements, such as a resilient inflated bladder. An insole layer which is usually a thin padded member, may be provided overtop of the midsole to enhance the comfort afforded to the wearer.

Typically, the shoe upper is constructed with a heel counter, i.e., a supportive panel that extends around the heel to keep the heel in place. Additionally, the soles of running shoes include a substantial arch portion integral with the rest of the sole. These features tend to reduce the flexibility of the shoe and inhibit optimal performance. Moreover, some prior art shoes have included a small arcuate dip in the ankle collar proximate to where the wearer'smalleolus bone would protrude in an attempt to reduce some of the rubbing between the upper and this bone. However, the remaining material under this dip causes reduced flexibility inhibiting optimal performance. Accordingly, an improved shoe, especially for running, jogging, and walking, was thus needed that provides better flexibility and a more anatomical fit to enhance performance.

SUMMARY OF THE INVENTION

Accordingly, it is therefore an object of the present invention to provide an article of footwear that overcomes deficiencies in the prior art shoes, particularly those that have existed in prior art shoes intended for the sport of running.

It is also an object of the present invention to provide a shoe having an increased level of comfort and support while maintaining maximum flexibility.

Other objects of the present invention will be apparent from the drawing figures and the description below.

DETAILED DESCRIPTION OF THE PREFERRED EMBODIMENT

Figure 1:
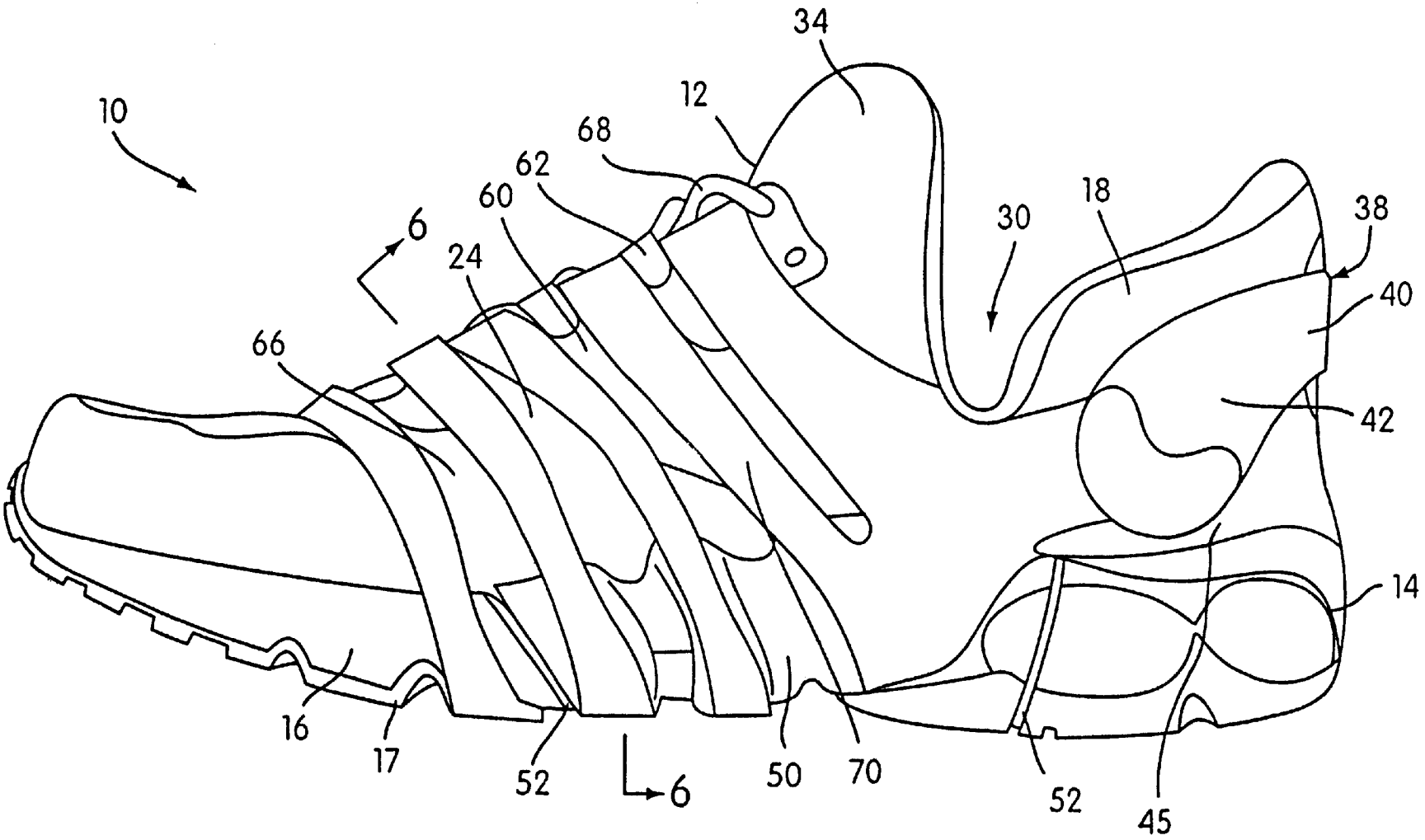
FIG. 1 is a medial side elevational view of the article of footwear of the present invention.
Figure 2:
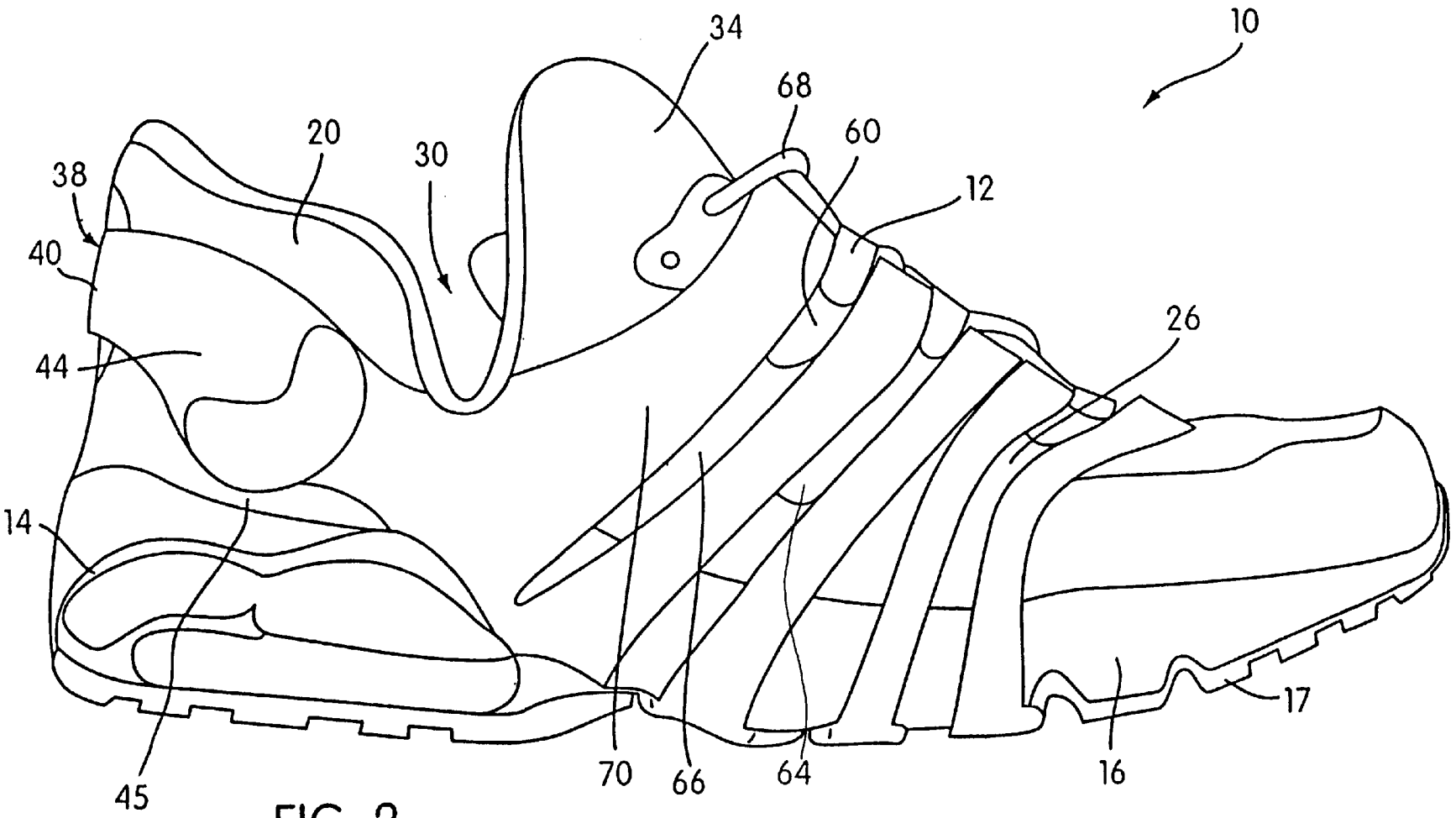
FIG. 2 is a lateral side elevational view thereof.
Figure 3:
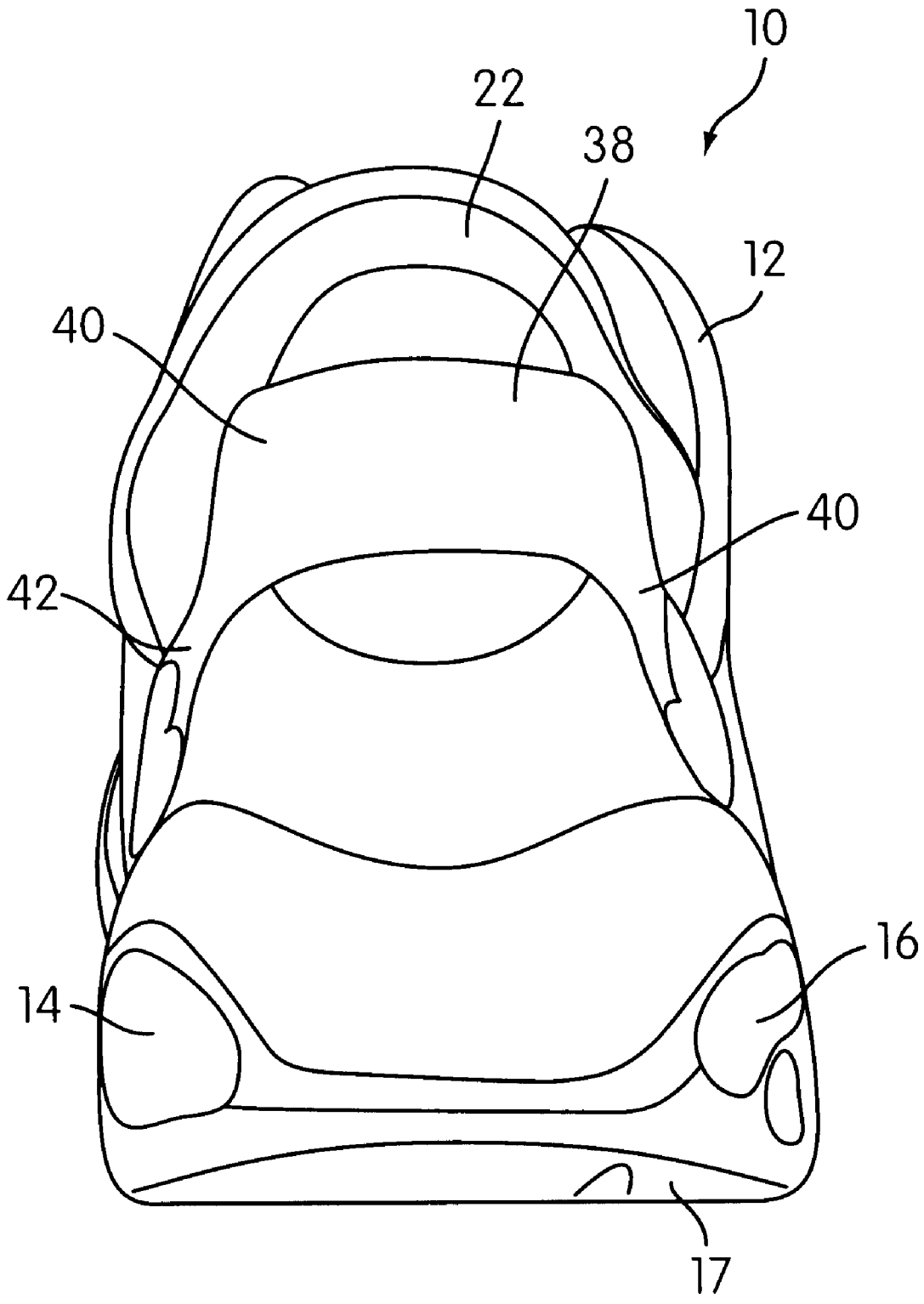
FIG. 3 is a rear elevational view thereof.
Figure 4:
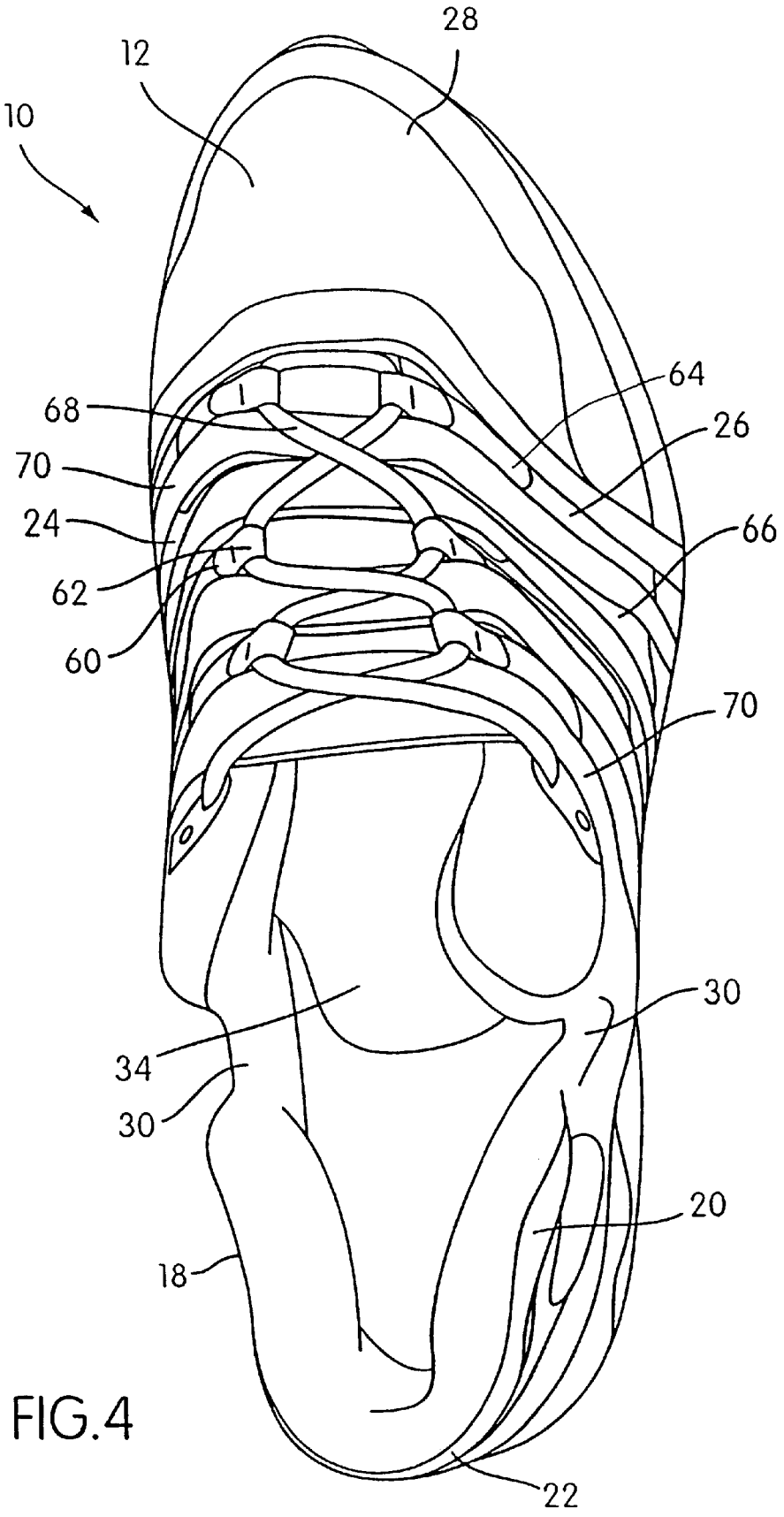
FIG. 4 is a top plan view thereof
Figure 5:
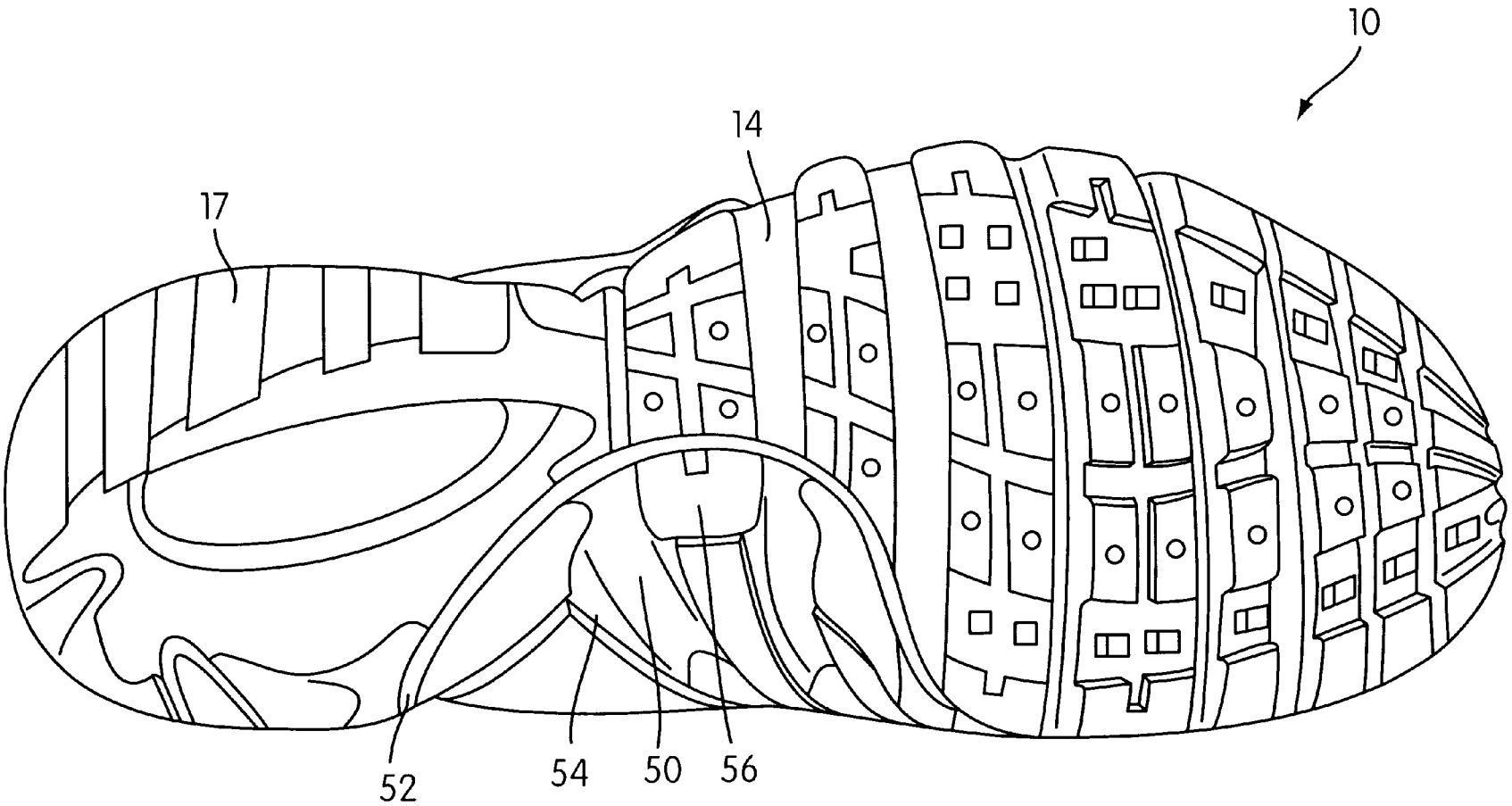
FIG. 5 is a bottom plan view thereof.
Figure 6:
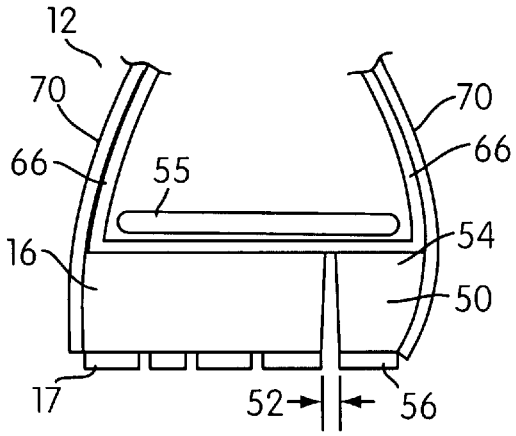
FIG. 6 is a partial sectional view taken through line 6—6 of FIG. 1.
Figure 7:
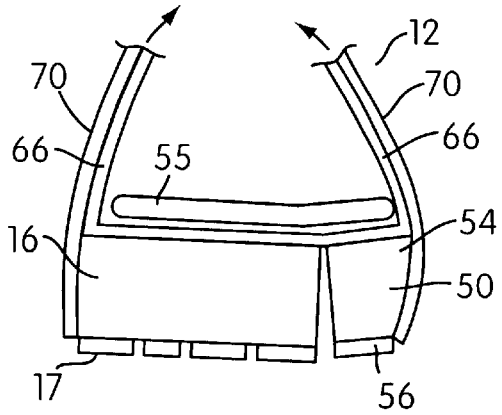
FIG. 7 is a sectional view similar to FIG. 7 shown with the laces in a tightened position.

An improved article of footwear, e.g., a shoe, is shown in FIGS. 1–9 and is designated generally by reference numeral 10. As will be evident from the description below, the shoe 10 includes an upper 12 and a sole 14 having a midsole 16 and an outsole 17. The upper 12, which can include one panel or a plurality of overlapping panels, includes a medial quarter portion 18, i.e., the medial part of the rear portion of the shoe where the foot enters, a lateral quarter portion 20, i.e., the lateral part of the rear portion of the shoe where the foot enters, a heel portion 22 that extends between the medial and lateral quarter portions 18 and 20, a medial and lateral vamp or side portion 24 and 26 on each side of the shoe 10, and a toe region 28.

Figure 9:
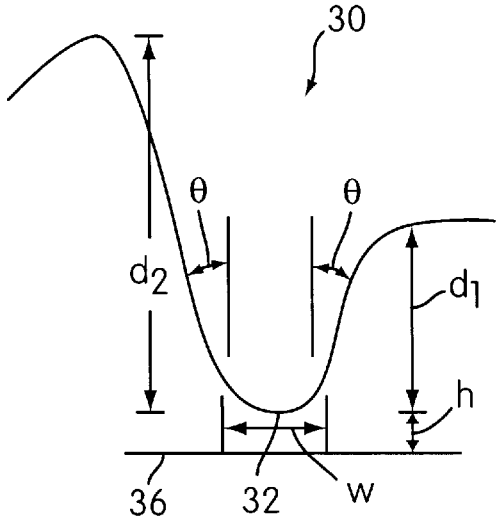
FIG. 9 is as schematic representation of the dimensions of the heel notch.

The medial quarter portion 18 and the lateral quarter portion 20 are each provided with an anatomically shaped heel notch 30. The heel notch 30 has a depth sufficient to effectively isolate the remainder of the heel material from the rest of the shoe upper 12. This, in turn, permits the heel portion to go through a full range of motion while remaining relatively unaffected with regard to forces associated with the forefoot and midfoot. This also separates the functions of the heel and midfoot to optimize articulation. As shown in FIG. 9, in a preferred embodiment, the depth d1 from the top of the quarter portion 18 or 20 to the base 32 of the notch is preferably between 40 to 65 mm. If the tongue 34 is integral with the upper, the preferred depth d2 from the tongue to the base 32 of the notch is approximately 80 mm. The width w of the base 32 of the heel notch 30 is preferably about 10 mm. The base 32 of the heel notch 30 is also preferably located a height h from the footbed 36 between approximately 0–15 mm. That is, the base 32 of notch 30 is preferably right at the height of the footbed 36 or can be positioned a height h above the footbed 36 less than or equal to 15 mm. As seen in the figures, the notches 30 are generally vertically oriented, and are positioned rearward of the midfoot region of the shoe 10 between the midfoot region and the heel region. Additionally, the taper angles θ between the general slopes of the heel notch 30 and a vertical axis are preferably between 5–30 degrees. The heel notch 30 eliminates the problems of the prior art designs wherein the material that would normally occupy the heel notch 30 of the present invention would bulge and flex as the wearer moved his foot. This resulted in providing undesirable resistance to the natural flexing of the wearer's foot and possibly caused undesirably rubbing against the user'smalleolus bones. Accordingly, the notch 30 of the present invention separates and isolates the heel of the shoe 10 from the midfoot to optimize articulation and flexibility.

Figure 8:
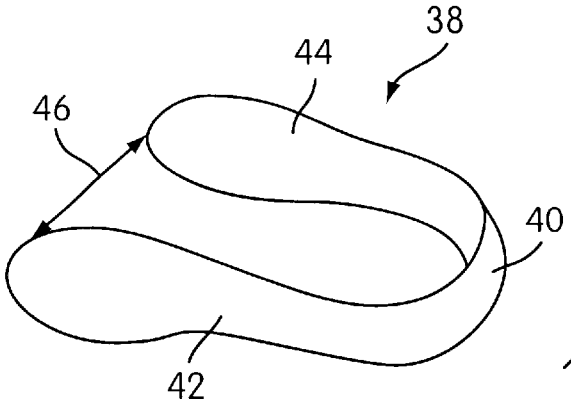
FIG. 8 is a perspective view of the heel clip used in the article of footwear.

The shoe 10 also includes a heel clip 38 for securely fitting the rear of the shoe 10 around the wearer's heel. As best shown in FIG. 8, heel clip 38 includes a base or back section 40, a medial side 42 and a lateral side 44. The medial and lateral sides 42 and 44 are coupled to the back section 40 in a manner that permits the medial and lateral sections 42 and 44 to behave like the are hinged to the back section 40 and biased inwardly towards each other. The opening 46 between the medial and lateral sides 42 and 44 is preferably smaller than the size of the heel of the typical wearer for that particular sized shoe. Thus, when the wearer inserts his foot into the shoe, the sides of the wearer's foot push outwardly against the medial and lateral sections 42 and 44 to widen the opening 46. However, once the foot is in place, the medial and lateral portions 42 and 44 of the heel clip 38 continuously press against the sides of the wearer's heel due to its biasing. Thus, the heel clip 38 effectively engages the entire heel surface to help provide a more anatomical fit and lock the heel into place. Moreover, the heel clip 38 removes the need for a structural heel counter around the heel of the foot. This is specifically beneficial because traditional heel counters reduce desired flexibility and may cause undesirable rubbing and irritation at the Achilles.

In a preferred embodiment, the heel clip 38 may be made from any suitable molded plastic. In the alternative, heel clip 38 may be made from a metal or any other material that provides the desired "memory" capabilities for the aforementioned biasing. Depending upon the material chosen, it may be desirable to provide padding on the inside of the heel clip 38 for the comfort of the wearer. If desired, heel clip 38 may be made with a plurality of parts to permit adjustability. Additionally, the rear of the shoe may be a soft material so as to avoid the disadvantages of the traditional heel counter. In the alternative, a thermoplastic rubber may be used to distribute the pressure to a larger region of the heel.

The heel clip 38 may be attached to the shoe 10 by any suitable method. For example, heel clip 38 may be permanently affixed to the shoe by sewing, or another suitable method. In the alternative, heel clip 38 may be removably attachable to the rear of the shoe 10 by slipping the clip in through loops or slots on the upper 12. Thus, the heel clip 38 may either be exposed on the outside of the shoe or unexposed inside the shoe 10. Additionally, the heel clip 38 may be made to be symmetrical, as shown, or asymmetrical with the medial side 42 slightly higher than the lateral side 44 to better accommodate to the anatomy of the foot.

The sole 14 includes a midsole 16 and an outsole 17 and covers the forefoot and the heel regions of the shoe. In the midfoot section, the sole 14 has a lateral portion that connects the forefoot and heel regions. An articulated arch 50 is generally semi-circular in shape and positioned in the arch region of the shoe 10 on the medial side between the forefoot, rearfoot, and lateral midfoot portions of the sole 14. The articulated arch 50 is preferably attached in any suitable manner to the lasted upper 12. However, articulated arch 50 is separate from the main sole 14 and is independent in its range of movement from the main sole 14. A gap 52 between the articulated arch 50 and the main sole 14 may be as small as zero or larger. It is only necessary to provide the ability to the articulated arch 50 to pull away from the main sole 14. As illustrated in the comparison between FIGS. 6 and 7, when the lacing system is tightened, an upward force is applied to the articulated arch 50. This allows the arch 50 to conform to the wearer's foot at a higher support level because its movement is independent of the main sole 14. This, in turn, adds additional and more anatomical support to the wearer's arch permitting optimal comfort, while enhancing flexibility and articulation. Optionally, a insole liner or pad 55 may be used to add additional conform for the wearer.

In a preferred arrangement, the articulated arch 50 may include a first portion 54 comprised of the same material used in the midsole 16 of main sole 14. Additionally, portions of articulated arch 50 may include a second portion 56, attached to the bottom of the first portion 54, that is comprised of the same traction material used in the outsole 17 of the main sole 14. However, the bottom surface or second portion 56 of the articulated arch is not likely to touch the ground or supporting surface during normal running or jogging activity due to the natural transfer of weight on the foot during these activities. However, the second portion 56 with traction material may be beneficial as a safety precaution as there may be occasions where the articulated arch 50 may engage the ground or supporting surface if the ground or supporting surface is uneven. Accordingly, it is not necessary to use an outsole material on the articulated arch 50.

In a preferred design, assuming a standard men's size 9 shoe, one preferred size for articulated arch 50 is 70 nm in a longitudinal direction of the shoe 10 and 23 mm at the widest point in a direction transverse to the longitudinal direction. This rear of the articulated arch 50 may be positioned approximately 90 mm forward from the heel. However, it is understood that the dimensions may vary and its size should correspond to the arch of the wearer's foot.

As previously described, the articulated arch 50 moves in response to the tightening of the shoe fastening system. In a preferred arrangement, as pictured, the shoe fastening system includes a plurality of non-stretch lace engaging elements 60, that may be made from nylon for example. The lace engaging elements 60 have a first end 62 containing eyelets, lace loops, or the like, and a second end 24 that is fixedly attached to the side panel 66 of the upper. The side panels 66 are preferably flexible and may be made from a flexible mesh. Thus, when a lace 68 is routed through the lace loops 62 and tightened, the non-flexible lace engaging elements 60 are pulled upwardly and inwardly. As the lace engaging elements 60 are attached to the flexible side panels 66, they too are pulled upwardly and inwardly, which in turn, tends to lift the articulated arch 50 and the main sole 14 upwardly. These forces will not have any significant effect on moving the main sole unit 14 because of the size of the main sole unit 14 and its relation to the wearer's foot. However, the articulated arch 50 will be lifted upwardly and inwardly to conform to the wearer's foot—providing better arch support and better articulation.

In addition to the upwardly force applied by the side panels 66, flexible straps 70 may be used to apply an additional, and more direct force on the articulated arch 50. On the medial side of the shoe, the flexible straps 70 are attached to the side of the articulated arch 50 and to the side panel 66 so that the stretching of the flexible side panel 66 also causes the flexible straps 70 to apply an upward and inward force to the articulated arch 50. The flexible straps 70 are attached in a similar manner to the lateral side but to not have a significant effect on the main sole 14 for the reasons described above. The flexible straps 70 can also be made, as pictured, to extend from, the articulated arch 50, to the medial side panel 66, across and over the tongue, to the lateral side panel 66 and to the main sole 14 on the lateral side. In this arrangement, the straps 70 help to hold the wearer's foot in the shoe 10 and help to act as a cushion between the lace 68 and the foot. As shown, the articulated arch 50 may be sculpted or shaped to specifically interface with the flexible straps 70. In a preferred embodiment, the flexible straps are made from a neoprene and are attached to the side panel 66 by a heat sensitive thermo-plastic rubber that acts as an adhesive to bond the two elements together.

In an alternative design, not shown, a center portion the medial side panel may be generally vertically separated from the remainder of the side of the upper, in the front and rear in areas generally corresponding to the front and rear of the articulated arch. This will provide a more direct force on the articulated arch. Moreover, this design permits the use of a non-flexible material in that region if desired.

While the independent articulated arch 50, the heel notch 30 and the heel clip 38 of shoe 10 work together to achieve the advantages previously described, it is recognized that any of these features can be used independently or in combination with the other features without the necessity to adopt all of these features.

While particular embodiments of the invention have been shown and described, it is recognized that various modifications thereof will occur to those skilled in the art. Therefore, the scope of the herein-described invention shall be limited solely by the claims appended hereto.

What is claimed is:

1. An article of footwear comprising:

a sole having a midsole and an outsole;

an upper, said upper attached to said sole forming an enclosure for securing a foot of a wearer to the sole, said upper having forward and rear sections;

a heel clip, said heel clip having a base section, a lateral arm, and a medial arm, said lateral and medial arms each having a first end coupled to said base section and a second end distal from said base section, said second end of said lateral arm and said second end of said medial arm being located on opposite sides of the upper, said heel clip being attached to the upper at a location spaced entirely above the sole providing a space on the upper between the clip and the sole, said heel clip extending around the rear section of the upper, said heel clip being made from a metal, said heel clip being adapted for providing a heel-locking force facilitating an anatomical fit between the heel of the foot of the wearer and the rear section of the upper;

a fastening system permitting the tightening of the upper around the foot of the user; and an articulated arch element; said articulated arch element attached to said upper and moves toward the foot of the user in response to the tightening of the fastening system.

2. The article of footwear of claim 1, wherein said medial arm, said lateral arm, and said base section of said heel clip are intergrally formed as a one-piece unit.

3. The article of footwear of claim 2, wherein the heel clip is permanently attached to the upper.

4. The article of footwear of claim 2, wherein the heel clip is removably coupled to slip receiving elements on the upper.

5. The article of footwear of claim 1, wherein said upper includes a medial quarter panel, a lateral quarter panel, a medial heel notch in the medial quarter panel having a depth of at least 40 mm, and a lateral heel notch in the lateral quarter panel having a depth of at least 40 mm.

6. An article of footwear comprising:

a sole having a midsole and an outsole;

an upper, said upper attached to said sole forming an enclosure for securing a foot of a wearer to the sole, said upper having forward and rear sections; and a heel clip, said heel clip having a base section, a lateral arm, and a medial arm, said lateral and medial arms each having a first end coupled to said base section and a second end distal from said base section, said second end of said lateral arm and said second end of said medial arm being located on opposite sides of the upper, said heel clip being attached to the upper at a location spaced entirely above the sole providing a space on the upper between the clip and the sole, said heel clip extending around the rear section of the upper, said heel clip being made from a metal, said heel clip being adapted for providing a heel-locking force facilitating an anatomical fit between the heel of the foot of the wearer and the rear section of the upper;

wherein said upper includes a medial quarter panel, a lateral quarter panel, a generally vertical medial heel notch in the medial quarter panel having a depth of at least 40 mm, and a generally vertical lateral heel notch in the lateral quarter panel having a depth of at least 40 mm.

7. The article of footwear of claim 2, wherein the upper includes an internal surface for contacting the foot of the wearer when in use, and an external surface, said heel clip being positioned on the external surface of the upper.

8. An article of footwear, said article of footwear comprising:

a sole having a midsole and an outsole;

an upper, said upper attached to said sole forming an enclosure for securing a foot of a wearer to the sole, said upper including a medial quarter panel and a lateral quarter panel, and forward and rear sections;

a fastening system, said fastening system permitting the tightening of the upper around the foot of the wearer;

an articulated arch element, said articulated arch element attached to said upper and moves toward the foot of the wearer in response to the tightening of the upper;

a medial heel notch in the medial quarter panel having a depth of at least 40 mm;

a lateral heel notch in the lateral quarter panel having a depth of at least 40 mm; and a heel clip, said heel clip having a base section, a lateral arm, and a medial arm, said lateral and medial arms each having a first end coupled to said base section and a second end distal from said base section, said second end of said lateral arm and said second end of said medial arm being located on opposite sides of the upper, said heel clip being attached to the upper at a location spaced above the sole and extending around the rear section thereof, said heel clip being made from a metal having a memory to provide a heel-locking force facilitating an anatomical fit between the heel of the foot of the wearer and the rear section of the upper.

9. The article of footwear of claim 8, wherein the article of footwear includes a lateral side, a medial side, and an arch region, and said articulated arch element is generally semicircular shaped and positioned in the arch region of the article of footwear on the medial side.

10. The article of footwear of claim 9, wherein the sole includes a main sole unit and the articulated arch element, said articulated arch element is physically separated from the main sole unit and is independent in its range of movement from the main sole unit.

11. The article of footwear of claim 10, further comprising a gap located between the articulated arch element and the main sole unit.

12. The article of footwear of claim 10, wherein said main sole unit includes a midsole portion being made from a cushioning material and an outsole portion being made from a ground contacting material, the articulated arch element includes a first portion made from the same cushioning material used in the midsole portion of the main sole unit.

13. The article of footwear of claim 12, wherein the articulated arch element includes a second portion, attached to the bottom of the first portion, that is made from the same ground contacting material used in the outsole portion of the main sole unit.

14. The article of footwear of claim 8, wherein said upper includes a medial side panel and a lateral side panel, the fastening system includes a lace and a plurality of non-stretch lace engaging elements, each non-stretch lace engaging element having an upper end with a lace coupling element cooperating with the lace, and a lower end fixedly attached to one of the medial and lateral side panels, said lace engaging the lace coupling elements, whereby the tightening of the lace pulls the non-flexible lace engaging elements upwardly and inwardly and lifts the articulated arch element upwardly toward the foot of the wearer.

15. The article of footwear of claim 14, further comprising flexible straps, each flexible strap being attached to the articulated arch element and to both the medial and lateral side panels.

16. The article of footwear of claim 15, wherein said flexible straps are positioned between adjacent non-stretch lace engaging elements.

17. The article of footwear of claim 8, wherein said upper further includes heel material, and wherein the medial and lateral heel notches are sized and shaped to effectively isolate the heel material from the rest of the upper.

18. The article of footwear of claim 17, wherein said upper is void of a heel counter.

19. An article of footwear comprising:

a sole having a midsole and an outsole;

an upper, said upper attached to said sole forming an enclosure for securing a foot of a wearer to the sole, said upper having forward and rear sections, said upper having lateral and medial heel notches formed therein, wherein the medial and lateral heel notches have a depth sufficient to effectively isolate the rear section from the rest of the upper; and a heel clip, said heel clip having a base section, a lateral arm, and a medial arm, said lateral and medial arms each having a first end coupled to said base section and a second end distal from said base section, said second end of said lateral arm and said second end of said medial arm being located on opposite sides of the upper, said heel clip being attached to the rear section of the upper at a location spaced entirely above the sole, said heel clip extending around the rear section of the upper, said heel clip being disposed to provide a heel-locking force to facilitate an anatomical fit between the heel of the foot of the wearer and the rear section of the upper.

20. The article of footwear of claim 19, further comprising a footbed, wherein each of said medial and lateral heel notches has a base positioned at a height above the footbed of 15 mm or less.

21. The article of footwear of claim 20, wherein each of said medial and lateral heel notches has side taper angles between 5–30 degrees from a vertical axis.

22. The article of footwear of claim 19, further including a tongue, wherein each of said medial and lateral heel notches has a base, wherein each notch has a depth between its base and the tongue of approximately 80 mm.

23. The article of footwear of claim 19, wherein said upper is void of a heel counter.

24. The article of outwear of claim 23, wherein the rear section of the upper includes an internal surface for contacting the foot of the wearer when in use, and an external surface, said heel clip being positioned on the external surface of the rear section of the upper.

25. The article of footwear of claim 24, wherein the heel clip is permanently attached to the upper.

26. An article of footwear comprising:

a sole having a midsole and an outsole;

an upper, said upper attached to said sole forming an enclosure for securing a foot of a wearer to the sole, said upper having forward and rear sections, said upper having lateral and medial heel notches formed therein, wherein each of said medial and lateral heel notches has a base;

a footbed upon which the foot of the wearer rests when the article of footwear is being worn;

wherein the base of each of said medial and lateral heel notches is positioned at a height above the footbed of 15 mm or less; and a heel clip, said heel clip having a base section, a lateral arm, and a medial arm, said lateral and medial arms each having a first end coupled to said base section and a second end distal from said base section, said second end of said lateral arm and said second end of said medial arm being located on opposite sides of the upper, said heel clip being attached to the upper at a location spaced entirely above the sole, said heel clip extending around the rear section of the upper, said heel clip being made from a metal, said heel clip being adapted for providing a heel-locking force facilitating an anatomical fit between the heel of the foot of the wearer and the rear section of the upper.

27. The article of footwear of claim 26, wherein each of said medial and lateral heel notches has side taper angles between 5–30 degrees from a vertical axis.

28. The article of footwear of claim 26, wherein the base of each of said medial and lateral heel notches has a width of approximately 10 mm.

29. The article of footwear of claim 26, wherein said upper is void of a heel counter.

30. The article of footwear of claim 26, wherein the rear section of the upper includes an internal surface for contacting the foot of the wearer when in use, and an external surface, said heel clip being positioned on the external surface of the rear section of the upper.

31. The article of footwear of claim 26, wherein the heel clip is permanently attached to the upper.

32. An article of footwear comprising:

a sole having a midsole and an outsole;

an upper, said upper attached to said sole forming an enclosure for securing a foot of a wearer to the sole, said upper having forward and rear sections, said upper having lateral and medial heel notches formed therein and wherein each of said medial and lateral heel notches has side taper angles between 5–30 degrees from a vertical axis; and a heel clip, said heel clip having a base section, a lateral arm, and a medial arm, said lateral and medial arms each having a first end coupled to said base section and a second end distal from said base section, said second end of said lateral arm and said second end of said medial arm being located on opposite sides of the upper, said heel clip being attached to the upper at a location spaced entirely above the sole, said heel clip extending around the rear section of the upper, said heel clip being made from a metal, said heel clip being adapted for providing a heel-locking force facilitating an anatomical fit between the heel of the foot of the wearer and the rear section of the upper.

33. The article of footwear of claim 32, wherein said upper further includes heel material, and wherein the medial and lateral heel notches are sized and shaped to effectively isolate the heel material from the rest of the upper.

34. The article of footwear of claim 32, wherein said upper is void of a heel counter.

35. The article of footwear of claim 34, wherein the rear section of the upper includes an internal surface for contacting the foot of the wearer when in use, and an external surface, said heel clip being positioned on the external surface of the rear section of the upper.

36. The article of footwear of claim 35, wherein the heel clip is permanently attached to the upper.

* * * * *